US007874941B1

(12) United States Patent
Boytos

(10) Patent No.: US 7,874,941 B1
(45) Date of Patent: Jan. 25, 2011

(54) CLIP-ON ALIGNMENT DEVICE FOR GOLFERS

(76) Inventor: John R. Boytos, 16430 Wanderers Port La., Onancock, VA (US) 23417

( * ) Notice: Subject to any disclaimer, the term of this patent is extended or adjusted under 35 U.S.C. 154(b) by 0 days.

(21) Appl. No.: 12/557,416

(22) Filed: Sep. 10, 2009

(51) Int. Cl.
*A63B 69/36* (2006.01)

(52) U.S. Cl. ..... 473/409; 473/207

(58) Field of Classification Search ..... 473/207, 473/208, 211, 212, 215, 409
See application file for complete search history.

(56) References Cited

U.S. PATENT DOCUMENTS 3,437,339 A * 4/1969 Starck ..... 473/210
3,643,960 A * 2/1972 Gentilly ..... 473/215
4,298,201 A * 11/1981 Palinkas ..... 473/210
4,637,612 A * 1/1987 Wilkins ..... 473/215
4,662,640 A 5/1987 Grander
5,149,099 A 9/1992 Radakovich
5,658,203 A 8/1997 Shub
5,820,493 A 10/1998 Price, Jr.
6,939,245 B1 * 9/2005 Mullarkey ..... 473/268
2003/0083140 A1 5/2003 Bamber
2004/0048679 A1 3/2004 Bunting

* cited by examiner

*Primary Examiner*—Nini Legesse

(57) ABSTRACT

An alignment device for helping a user perform a golf swing comprising a clamp having a first end, a middle portion, and a second end; a pair of pinchers for gripping one's shoulders disposed on the first end of the clamp, the pair of pinchers can move between an open position and a closed position, the pinchers are biased in the closed position caused by a spring disposed in the middle portion of the clamp; and an extension component pivotally attached to the second end of the clamp and extending outwardly from the clamp. The extension component may resemble a golf ball and a golf tee.

1 Claim, 3 Drawing Sheets

CLIP-ON ALIGNMENT DEVICE FOR GOLFERS

FIELD OF THE INVENTION

The present invention is directed to a clip, more particularly to a clip attachable to a golfer's shoulder that features an alignment component for helping the golfer align his/her body appropriately before he/she swings.

BACKGROUND OF THE INVENTION

Golf is an extremely popular sport and many individuals spend a great deal of time practicing. The present invention is directed to a device for helping a golfer improve his/her swing. The device can be clipped on to a golfer's shoulder (on his/her shirt). The device comprises an alignment component that helps the golfer assume the proper position prior to a swing.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-5, the present invention features a clip-on alignment device 100 for attaching to a golfer's shoulder 106. The alignment device 100 may be used as a training aid to help teach a golfer 105 the appropriate body position during a swing. Without wishing to limit the present invention to any theory or mechanism, it is believed that the alignment device 100 of the present invention is advantageous because it may help teach a golfer 105 to align his/her body correctly before he/she swings and may reduce swaying. The alignment device 100 may help a golfer 105 achieve a more effective swing. In addition, the alignment device 100 is advantageous because it is small and easy for a golfer 105 to carry with him/her.

Figure 1:
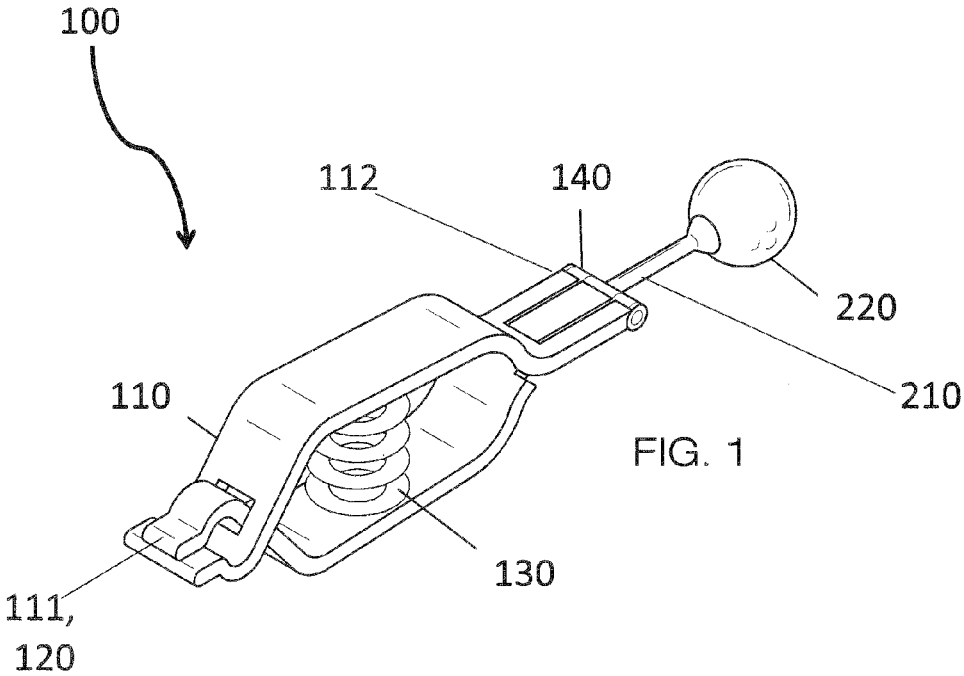
FIG. 1 is a first perspective view of the clip-on alignment device of the present invention.
Figure 2:
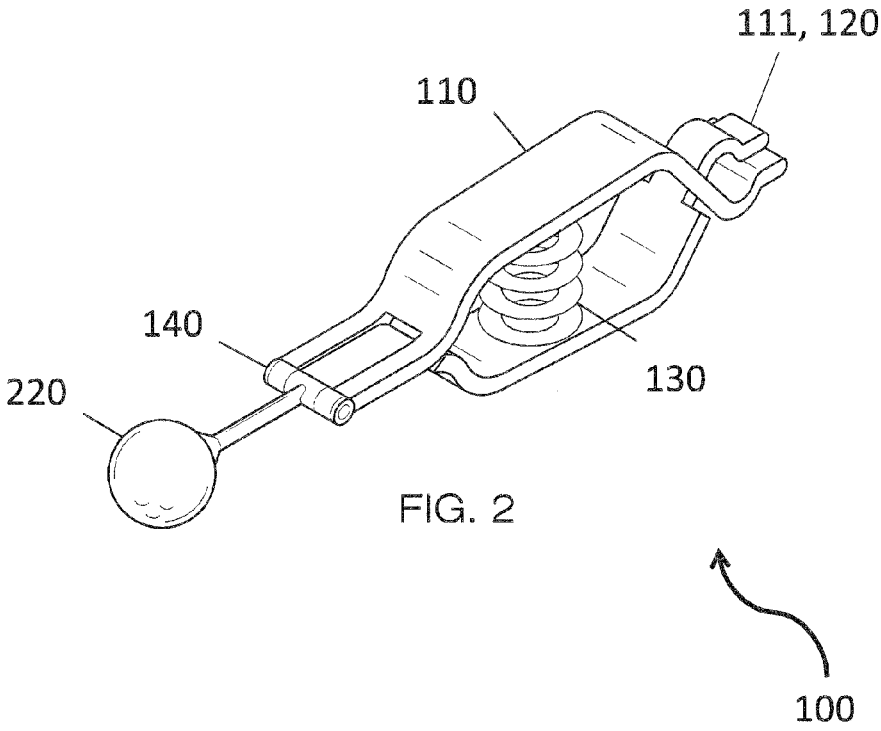
FIG. 2 is a second perspective view of the alignment device of FIG. 1.
Figure 3:
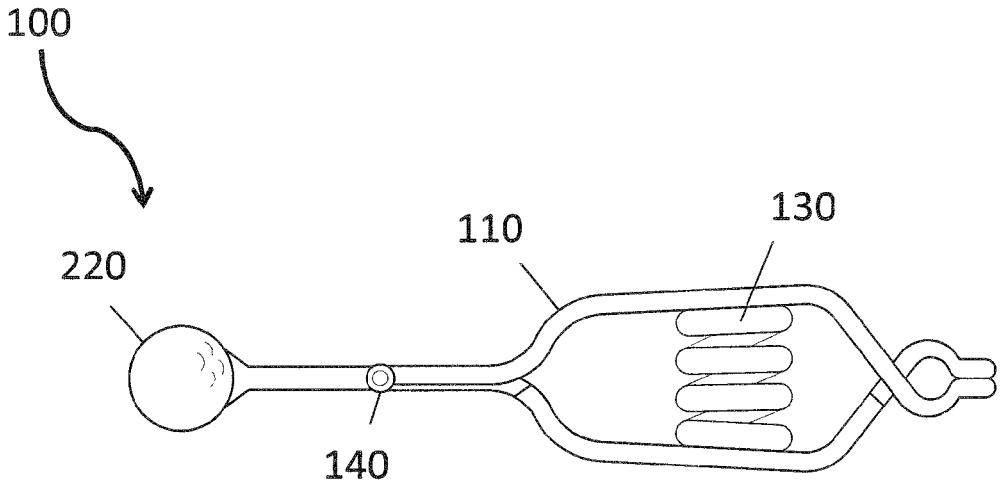
FIG. 3 is a side view of the alignment device of FIG. 1.
Figure 4:
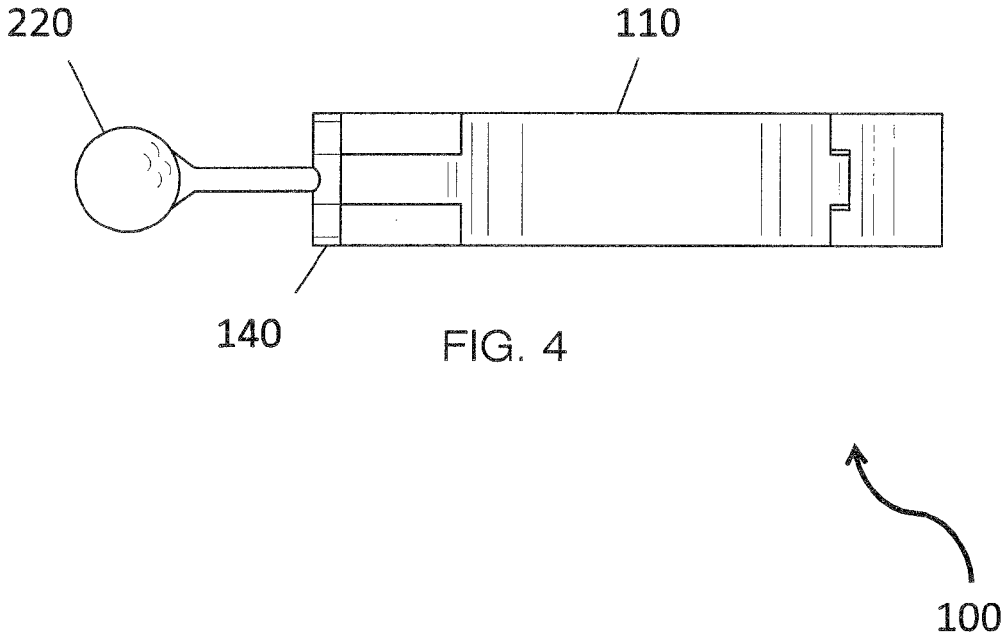
FIG. 4 is a top view of the alignment device of FIG. 1.
Figure 5:
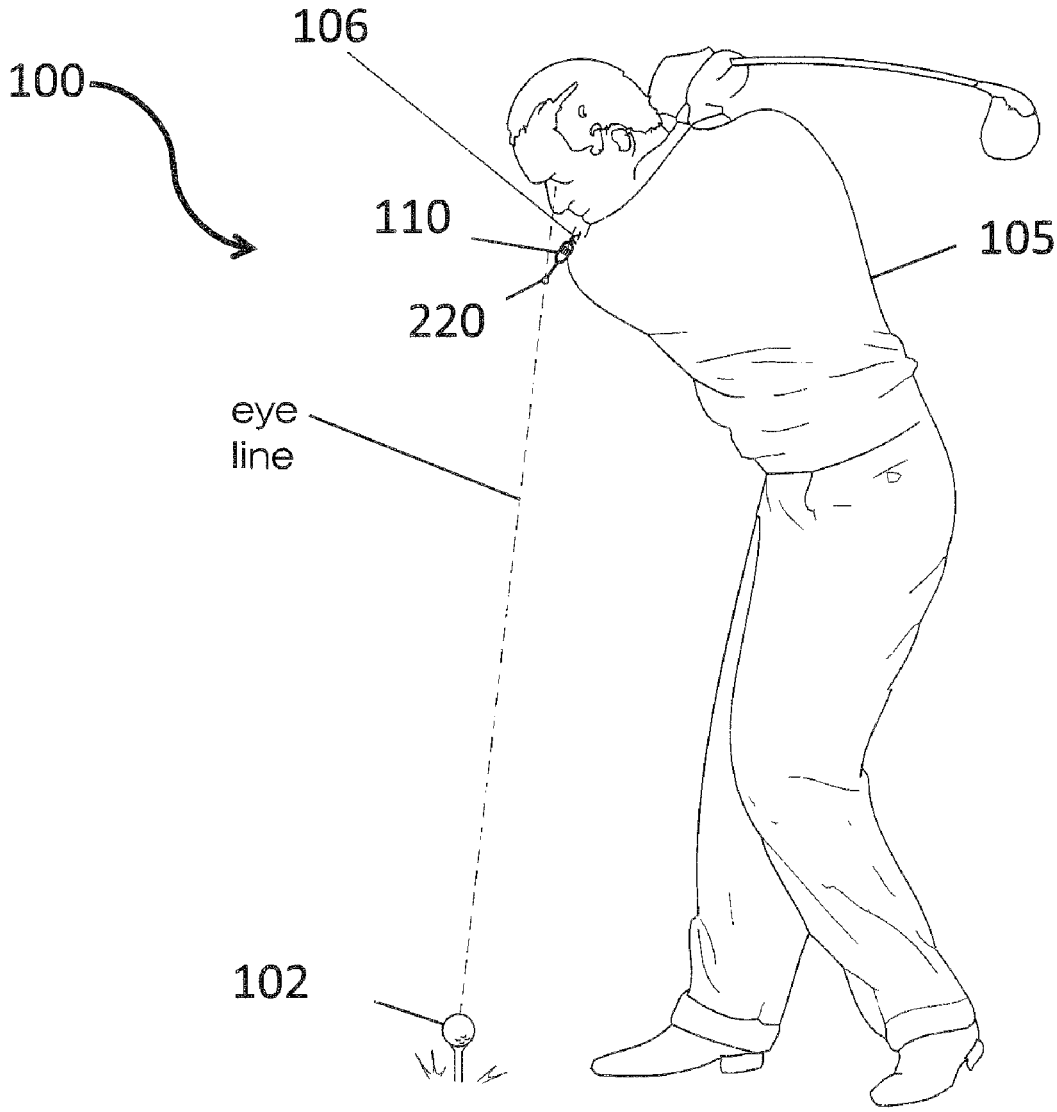
FIG. 5 is a perspective view of the alignment device of the present invention as attached to a golfer's shoulder.

The clip-on alignment device 100 of the present invention is for attaching to a goiter's shoulder 106 (e.g., his/her clothing). The clip-on alignment device 100 may utilize a number of different means of attaching to the golfer's shoulder 106. For example, as shown in FIG. 1, in some embodiments the alignment device 100 comprises a spring-loaded clip mechanism. In some embodiments, the alignment device 100 comprises a pin, a hook mechanism, the like, or a combination thereof.

Generally, the clip-on alignment device comprises a clamp 110 having a first end 111, a middle portion, and a second end 112. Disposed on the first end 111 is a pair of pinchers 120 for gripping the user's shirt. The pinchers 120 can move bet en an open position wherein the pinchers 120 are separated and a closed position wherein the pinchers 120 are compressed together. The pinchers 120 are biased in the closed position caused by a spring 130 (e.g., disposed in the middle portion of the clamp 110). By squeezing the middle portion of the clamp 110 (which compresses the spring 130), the pinchers 120 are moved to the open position and can be wrapped around a portion of the user's shirt. The middle portion of the clamp 110 can be released, leaving the pinchers 120 clamped around the user's shirt.

The device 100 of the present invention further comprises an extension component disposed on the a tend end 112 of the clamp 110. In some embodiments, the extension component may be pivotally attached to the second end 112 of the clamp 110 via a hinge 140. The extension component generally extends outwardly from the clamp 110. Generally, the extension component lies in the same plane as the clamp 110.

In some embodiments, the extension component comprises a shaft 210 (e.g., resembling a golf tee) to which a ball 220 (e.g., a golf ball) is attached. The first end of the shaft 210 is attached to the second end 112 of the clamp 110. The ball 220 is attached to the second end of the shaft 210.

The present invention also features met of performing a golf swing (e.g., using the alignment device 100 of the present invention). To use the alignment device 100 of the present invention, a golfer 105 can attach the device 100 to his/her shoulder via the clamp 110. The golfer can then prepare for a swing. During the upswing, the golfer 105 twists his/tier torso as he/she swings the golf club backwardly. When the golfer 105 is in this position (e.g., has finished the upswing part of the swing), he/she can use the ball 220 of the alignment device 100 to help make sure he/she is in the correct position. For example, he/she can focus on the golf ball 102 on the ground while simultaneously viewing the ball 220 of the alignment device 100 with higher peripheral vision. He/she can align the golf ball with the ball 220. Then, the golfer may begin the downswing.

The alignment device 100 of the present invention may be constructed from a variety of materials and in a variety of sizes. For example, in so embodiments, the device 100 is constructed from metal, plastic, wood, the like, or a combination thereof. In some embodiments, the clamp 110 is between about 0.5 to 1.0 inches in length as measured from the first end 111 to the second end 112. In some embodiments, the clamp 110 is between about 1 to 1.5 inches in length as measured from the first end 111 to the second end 112. In some embodiments, the clamp 110 is between about 1.5 to 2 inches in length as measured from the first end to the second end. In some embodiments, the clamp 110 is more than about 2 inches in length.

As used herein, the term "about" refers to plus or minus 10% of the referenced number. For example, an embodiment wherein the clamp 110 is about 2 inches in length includes a clamp 110 that is between 1.8 and 2.2 inches in length.

The following the disclosures of the following U.S. patents are incorporated in their entirety by reference herein: U.S. Pat. No. 5,658,203; U.S. Pat. Application No. 2004/0048679; U.S. Pat. No. 5,820,493; U.S. Pat. No. 4,662,640; U.S. Pat. No. 5,149,099; U.S. Pat. No. 2003/0083140.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A method of swinging a golf club, said method comprising:

(a) obtaining an alignment device comprising:

(i) a clamp having a first end, a middle portion, and a second end;

(ii) a pair of pinchers disposed on the first end of the clamp, the pair of pinchers can move between an open position wherein the pinchers are separated and a closed position wherein the pinchers are compressed together, the pinchers are biased in the closed position caused by a spring disposed in the middle portion of the clamp, wherein squeezing the spring moves the pinchers to the open position and releasing the spring moves the pinchers back to the closed position; and (iii) an extension component comprising a shaft and a ball, a first end of the shaft is pivotally attached to the second end of the clamp, the ball is attached to a second end of the shaft;

(b) attaching the alignment device to a shoulder area;

(c) performing a golf upswing;

(d) focusing on a golf ball on a ground surface and simultaneously viewing the ball of the alignment device;

(e) aligning visually the ball of the alignment device with golf ball; and (f) perform a golf downswing.

* * * * *